United States Patent [19]

Fischer et al.

[11] Patent Number: 4,565,235

[45] Date of Patent: Jan. 21, 1986

[54] APPARATUS FOR COMPACTING GRANULAR MOLDING MATERIALS BY PRESSURIZED GASEOUS MEDIUMS

[75] Inventors: Kurt Fischer; Hans Tanner, both of Schaffhausen, Switzerland

[73] Assignee: Georg Fischer Aktiengesellschaft, Switzerland

[21] Appl. No.: 541,573

[22] Filed: Oct. 13, 1983

[30] Foreign Application Priority Data

Oct. 15, 1982 [CH] Switzerland ..... 6014/82

[51] Int. Cl.[4] ..... B22C 15/00

[52] U.S. Cl. ..... 164/169; 164/37

[58] Field of Search ..... 164/169, 37, 200–202

[56] References Cited

U.S. PATENT DOCUMENTS 4,529,026 7/1985 Köbel et al. ..... 164/37

FOREIGN PATENT DOCUMENTS

WO82/03348 10/1982 Int'l Pat. Institute ..... 164/38

*Primary Examiner*—Nicholas P. Godici
*Assistant Examiner*—J. Reed Batten, Jr.
*Attorney, Agent, or Firm*—Roylance, Abrams, Berdo & Goodman

[57] ABSTRACT

The apparatus has a plurality of tubular hollow members arranged between the pressure chamber and the molding units, in the pressure surge flow direction, for conducting the gaseous medium to the top of the molding material. With distribution of the pressure medium flow through a plurality of independent and different cross sections, the lifting force required to open the packing element is greatly reduced and the packing element can be opened rapidly.

20 Claims, 4 Drawing Figures

APPARATUS FOR COMPACTING GRANULAR MOLDING MATERIALS BY PRESSURIZED GASEOUS MEDIUMS

FIELD OF THE INVENTION

The present invention relates to an apparatus for compacting granular molding materials, particularly foundry molding sand, by applying a surge of gaseous pressure to the surface of a mass of molding material poured loosely over a mold pattern unit.

BACKGROUND OF THE INVENTION

Conventional apparatus for compacting granular molding materials with pressurized gases, particularly compressed air, have a passage opening between its pressure chamber and mold unit covered by a diaphragm or a plate-like shut-off element. The diaphragm or element closes and opens the passage opening to permit the air pressure to contact and compress the molding material.

When the full passage opening is in use in the conventional apparatus, the transverse cross-sectional area of the passage opening determines the force required to lift the packing element. Such packing element can be a diaphragm, a valve disk or some other device. The larger the cross-sectional area of the passage opening, the greater is the required lifting force to open the passage opening.

The greater lifting forces, required for conventional apparatus with large transverse cross-sectional area passage openings, are difficult to attain. This is especially the situation with rapid-opening devices because of the short time available to move the packing element.

SUMMARY OF THE INVENTION

An object of the present invention is to provide an apparatus for compacting granular molding material by a surge of pressure of a gaseous medium wherein the lifting forces for moving the packing element to open the passage opening, even for relatively large cross-sectional area passage openings, are minimized, and wherein complete flowthrough is attained in a very short reaction time.

The foregoing object is obtained by an apparatus for compacting granular molding materials, particularly foundry molding sand, comprising a pressure chamber which can form a closed system with a molding material filled molding unit at the pressure chamber outlet, a passage providing fluid communication between the pressure chamber and the outlet, and a common packing element. The passage includes a plurality of hollow members extending within the pressure chamber and separated from each other in the pressure chamber. Each hollow member has a first open end within the pressure chamber and a second open end opening at the outlet. The common packing element releasably covers and closes each of the first open ends to control fluid pressure flow from the pressure chamber to the molding unit.

By forming the apparatus in this manner, the hollow members, extending through the pressure chamber, separate the total cross-sectional area of the passage and expose the packing element to the fluid pressure in the pressure chamber so that such fluid pressure exerts an upward force on the packing element tending to move the packing element upwardly to an open position. The cross-sectional areas of the individual hollow members determine the lifting force required for the packing element. Thus, the required lifting force is relatively small and the time required to open the passage is minimized.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
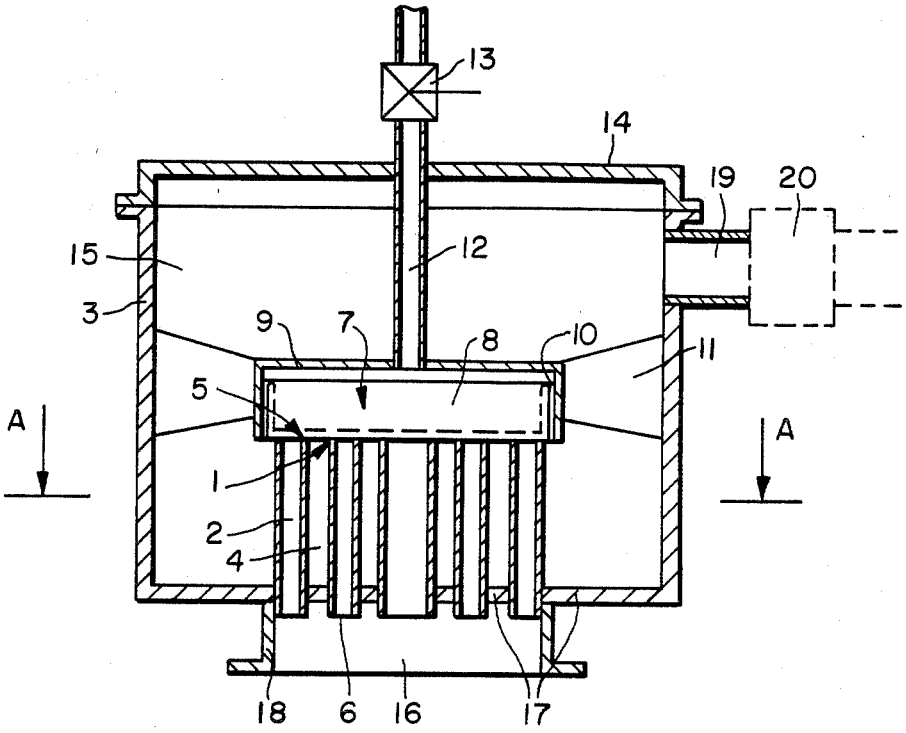
FIG. 1 is a side elevational view in section of an apparatus for compacting granular molding materials according to a first embodiment of the present invention.

FIGS. 1 to 4 illustrate embodiments of the present invention having similar features. A packing plane 1 is formed by first open ends 5 of a plurality of tubular hollow members or bodies 2. Hollow members 2 are mounted in a pressure chamber housing 3 separately and spaced from each other, forming spaces 4 between the hollow members. Spaces 4 and the inside 15 of the housing 3 provide an undivided or continuous space. The second open ends 6 of the hollow members opposite packing plane 1 open to the outside of housing 3 and in a molding unit over a mass of molding material. Hollow members 2 can be arranged so that their longitudinal axes extend parallel to each other. Alternatively, the axes can extend somewhat radially relative to each other. The second open ends 6 of hollow members 2 opposite packing plane 1 are tightly connected with a part of housing 3 forming part of the housing wall. The lengths and the spacing of hollow members 2 projecting into the pressure space and spaces 4 between the hollow members 2 can be arranged in any cross-sectional alignment depending on the plurality of hollow member cross-sectional configurations provided. Additionally, the required quantitative low-loss flowthrough of pressure medium can be met.

FIG. 1 shows a packing element 7 in the form of a plate-like piston. Element 7 is constructed with one or more aperture-like cutouts 8 to save weight, and is coated closely with an elastomer.

This piston packing element is inserted in an air-tight packing housing 9 with the packing element guided loosely with little lateral play within the periphery of packing housing inside surface 10. About 0.1–0.3 mm lateral play is required.

Such piston can also be concave so that it can be guided properly.

The packing housing 9 is connected by reinforcements 11 with housing 3. Compressed gas, e.g. compressed air, is conducted through control line 12 in the housing cover 14 and into packing housing 9 for actuation of piston packing element 7. Control line 12 can be attached through a valve 13 to a suitable control device. Valve 13 can be operated pneumatically, hydraulically or electrically.

Open ends 6 of hollow members 2 opposite packing plane 1 open in a discharge part or outlet 16 of housing 3. Ends 6 are tightly attached to their peripheries with a base part 17 of housing 3. This discharge part 16 has a flange connection 18, in the present embodiment, which is configured for connection with a molding unit. Other types of connections can be used. An air pressure feed line 19 is mounted on the side of the housing to supply pressure medium to the housing inside 15. The valve 20 can be provided in line 19.

Figure 2:
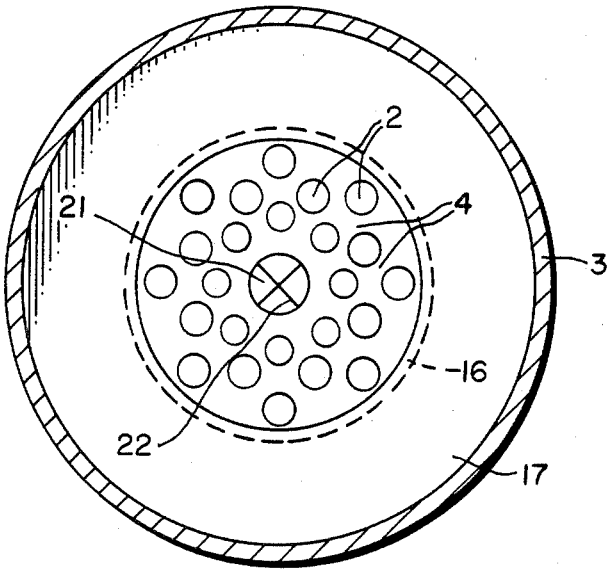
FIG. 2 is a top plan view in section of the apparatus taken along line A—A of FIG. 1.

FIG. 2 shows a cross-sectional view through the hollow member arrangement of FIG. 1, along line A—A. The hollow members are formed as pipes with partially the same and partially different, circular cross-sectional configurations. However, the hollow members can also have polygonal cross-sectional configurations and/or be conical in length. The longitudinal axes of hollow members 2 in FIGS. 1–2 are parallel to each other. The horizontal cross section of hollow members 2 and the corresponding cross section of the intermediate spaces 4 between hollow members 2 are aligned generally for the flow of the pressure medium. Thus, it can be advantageous, from a flow technology consideration, to vary the hollow member cross sections from the outside inward, relative to a bundle of hollow members. Larger hollow member cross sections 21 are advantageously subdivided by transverse rods 22, to distribute the pressure of packing element 7.

Figure 3:
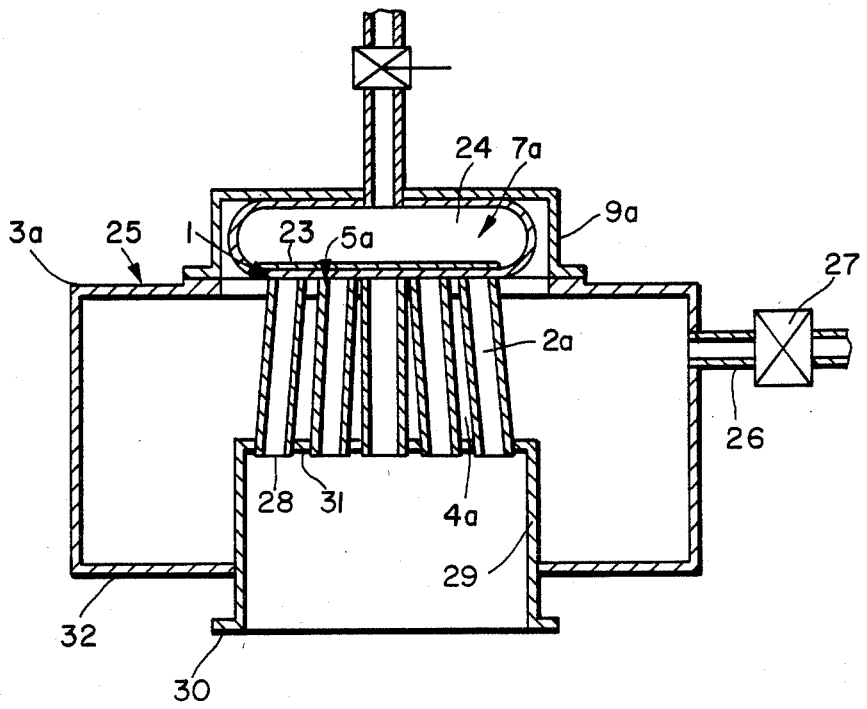
FIG. 3 is a side elevational view in section of an apparatus for compacting granular molding materials according to a second embodiment of the present invention.

FIG. 3 shows an apparatus similar to that of FIG. 1, but with a closed packing element. Hollow members **2*a* are in a radiating configuration, and can be cylindrical or conical. The hollow members are separated and spaced from each other in the pressure chamber, forming spaces 4*a* between the hollow members. Packing element 7*a*, engaging hollow member open ends 5*a* in packing plane 1, is configured as a one-piece, unitary, integral unit. The side of the element 7*a* facing packing plane 1 is provided with a reinforcement plate 23 to receive the packing pressure. The reinforcement plate 23 is of light metal to avoid creating large forces. Plate 23 can also be plastic, and is of suitable configuration. To guarantee stability of the shape of the plate in a pressure-less state, a material is selected for use on this side of packing element 7*a*** which has a sufficient inherent rigidity, but is nonetheless flexible. Reinforced elastomers are suitable.

The hollow space 24 of packing element **7*a*** can be filled with a pasty substance, a suitable liquid or the like, to improve the rigidity when it is in a pressureless state, and to keep the hollow space as small as possible.

Pressure chamber housing **3*a* has a packing housing 9*a* on the top 25 for packing element 7*a*. Housing 9*a* is detachably connected with housing 3*a*. On the side of housing 3*a*, a feed line 26 is provided for the pressure medium, e.g. compressed air. A valve 27 is provided to close or open the feed line 26. The discharge ends 28 of hollow members 2*a* open into a cylindrical discharge part 29 which is provided with a connection flange 30. Ends 28 are connected tightly with a base 31 of discharge part 29. However, it is also possible to connect ends 28 of hollow members 2*a* directly with pressure chamber housing base 32, without connection to discharge part 29. The requirement that the sum of the intermediate spaces 4*a* between hollow members 2*a*** is at least as great as the total cross-sectional area of the plurality of hollow member cross sections must be fulfilled. This guarantees a direct flowthrough of the pressure medium.

Figure 4:
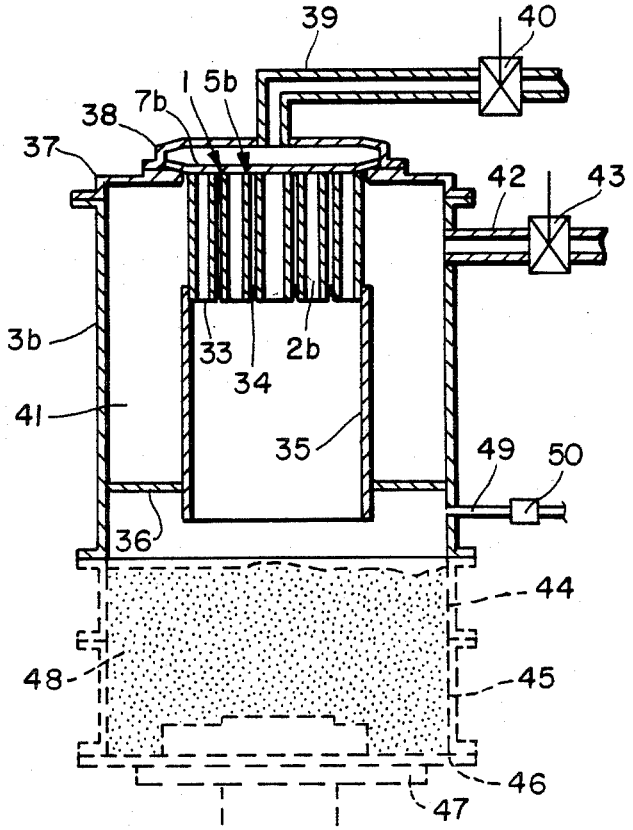
FIG. 4 is a side elevational view in section of an apparatus for compacting granular molding materials according to a third embodiment of the present invention.

FIG. 4 shows an embodiment with a molding apparatus for the manufacture of foundry molds and with a diaphragm-like packing element.

The top of pressure chamber housing **3*b* is closed with a cover 37 in which packing plane 1 is located. Packing plane 1 is similar to that in FIG. 1, i.e., made from a plurality of ends 5*b* of hollow members 2*b*. The hollow members are aligned in the flow direction of the pressure medium and are separated from each other. Ends 5*b*** of hollow members define packing surfaces.

The discharge ends 33 of hollow members **2*b* are connected tightly at their outside peripheries with a base part 34 of a discharge part 35. Discharge part 35 is incorporated into the base part 36 of housing 3*b* and thus, together with the cover 37 and packing element 7*b*, limit the inside space 41** of the pressure chamber housing.

A plate, provided as a diaphragm, forms packing element **7*b*. Element 7*b* is held at its periphery both by housing cover 37 and by packing cover 38. A control line 39 extends through the cover 38 for actuating diaphragm 7*b* with air. Line 39 can be operated through a valve 40 which can be operated pneumatically, hydraulically, or electrically. A feed line 42 for a conveyor or pressure medium, e.g. compressed air, is provided on the side of the pressure chamber housing wall. A valve 43 inserted in line 42, as needed, allows constant or interrupted feed of compressed gas to the inside 41 of housing 3*b***.

The apparatus of FIG. 4 is illustrated in combination with a molding unit (shown in phantom lines). Housing **3*b*** is configured with its bottom end having means for coupling it to the molding unit.

The molding unit comprises a loading chamber 44 in a molding box 45 and a pattern assembly 46. A cylindrical elevator arrangement 47 lifts and lowers this unit. Molding material 48 is provided in the proper amount in box 45 via an aerating line 49 with a valve 50. Thus, the compressed gas remaining after the in-flow can be expanded through the molding material before lowering the molding unit. The unit is then subsequently separated.

The apparatus according to the present invention operates as follows.

Assuming that a gaseous medium must be conveyed, a control pressure medium is passed through the control line at a predetermined pressure to the packing element which is thereby brought into the packing or closed position on the packing surface. A conveyor or pressure medium is then brought through the feed line into the pressure chamber housing, i.e. into the pressure space, and readies the apparatus to conduct the pressure medium or to produce a surge of pressure.

It is easy to provide the pressure for the control medium in the same manner as for the conveyor or pressure medium. The mediums can be of the same type.

Thereafter, the pressure in the control line is lowered by operation of the control valve so that the pressure, which had been greater until this time, on the control side of the packing element is reduced below the pressure on the pressure chamber side. The force working on the pressure space side of the packing element raises the element when equilibrium has been passed. In this manner, the packing element is raised suddenly and the conveyor medium can be discharged as a surge of pressure.

While various embodiments have been chosen to illustrate the invention, it will be understood by those skilled in the art that various changes and modifications can be made therein without departing from the scope of the invention as defined in the appended claims.

What is claimed is:

1. An apparatus for compacting granular molding material, particularly foundry molding sand, by a surge of pressure of a gaseous medium, comprising:

a pressure chamber having coupling means, mounted at an outlet of said pressure chamber, for forming a closed system with a molding unit in which molding material has been loosely poured;

a passage providing fluid communication between said pressure chamber and said outlet, said passage including a plurality of hollow members extending within said pressure chamber and separated from each other in said pressure chamber by spaces which are continuous, undivided extensions of said pressure chamber, each of said hollow members having a first open end within said pressure chamber and a second open end opening at said pressure chamber outlet;

a common packing element releasably covering and closing each of said first open ends to control flow of fluid pressure from said pressure chamber to the molding unit, said packing element having a first side engaging said hollow members and subjected to fluid pressure in said pressure chamber and having an opposite second side; and pressure means for holding said packing element in opposition to forces applied to said packing element by said fluid pressure in said pressure chamber;

whereby, upon releasing said pressure means, said packing element will move quickly away from said hollow members by the forces applied by said fluid pressure in said pressure chamber permitting said fluid pressure in said pressure chamber to pass through said hollow members and be discharged through said pressure chamber outlet.

2. An apparatus according to claim 1 wherein said pressure chamber comprises means for coupling said pressure chamber to a fluid pressure source.

3. An apparatus according to claim 1 wherein said packing element has means for controlling movement thereof relative to said first open ends to control flow of pressure medium through said hollow members and to said outlet.

4. An apparatus according to claim 1 wherein said pressure means engages and applies opposing forces on said second side of said packing element.

5. An apparatus according to claim 1 wherein said packing element comprises an integral plate member.

6. An apparatus according to claim 1 wherein said packing element is slidably mounted in a housing located in said pressure chamber, said pressure means supplying fluid pressure against said second side of said packing element in said housing.

7. An apparatus according to claim 1 wherein said packing element comprises a reinforcement plate engaging said hollow members and a flexible hollow body coupling and sealing said reinforcement plate to said pressure means.

8. An apparatus according to claim 1 wherein said packing element comprises a diaphragm.

9. An apparatus according to claim 1 wherein said hollow members are tubular.

10. An apparatus according to claim 9 wherein said hollow members are circular in transverse cross section.

11. An apparatus according to claim 9 wherein said hollow members are polygonal in transverse cross section.

12. An apparatus according to claim 9 wherein said hollow members are conical and flare outwardly toward said second open ends.

13. An apparatus according to claim 9 wherein said hollow members have longitudinal axes which are substantially parallel.

14. An apparatus according to claim 9 wherein said hollow members have longitudinal axes radiating outward from said first open ends to said second open ends.

15. An apparatus according to claim 9 wherein each of said hollow members has a substantially identical cross-sectional configuration.

16. An apparatus according to claim 9 wherein said hollow members have substantially different cross-sectional configurations.

17. An apparatus according to claim 9 wherein said hollow members are concentric.

18. An apparatus according to claim 1 wherein said pressure means comprises pneumatic control means for controlling movement of said packing element.

19. An apparatus according to claim 12 wherein said second side is subjected to pressure from said pneumatic control means.

20. An apparatus according to claim 19 wherein said pressure chamber has means for regulating the pressure therein.

* * * * *